US006348892B1

(12) United States Patent
Annamaa et al.

(10) Patent No.: US 6,348,892 B1
(45) Date of Patent: Feb. 19, 2002

(54) INTERNAL ANTENNA FOR AN APPARATUS

(75) Inventors: Petteri Annamaa, Oulu; Jyrki Mikkola, Kempele, both of (FI)

(73) Assignee: Filtronic LK OY, Kempele (FI)

( * ) Notice: Subject to any disclaimer, the term of this patent is extended or adjusted under 35 U.S.C. 154(b) by 0 days.

(21) Appl. No.: 09/691,672

(22) Filed: Oct. 18, 2000

(30) Foreign Application Priority Data

Oct. 20, 1999 (FI) ..... 19992268

(51) Int. Cl.[7] ..... H01Q 1/24; H01Q 1/38

(52) U.S. Cl. ..... 343/700 MS; 343/702; 343/846

(58) Field of Search ..... 343/700 MS, 846, 343/829, 848, 830, 702; H01Q 1/24, 1/38

(56) References Cited

U.S. PATENT DOCUMENTS

| | | | | |
|---|---|---|---|---|
| 4,791,423 A | * 12/1988 | Yokoyama et al. | .. | 343/700 MS |
| 5,124,733 A | 6/1992 | Haneishi | ..... | 343/700 |
| 5,453,754 A | 9/1995 | Fray | ..... | 343/789 |
| 5,568,155 A | * 10/1996 | Tsunekawa et al. | .. | 343/700 MS |
| 5,880,694 A | 3/1999 | Wang et al. | | |
| 5,945,950 A | 9/1999 | Elbadawy | ..... | 343/700 |

FOREIGN PATENT DOCUMENTS

| | | | | |
|---|---|---|---|---|
| EP | 777295 | 4/1988 | ..... | H01Q/9/04 |
| EP | 279050 | 8/1988 | ..... | H01Q/9/04 |
| EP | 0279050 | 8/1988 | ..... | H01Q/9/04 |
| EP | 0777295 | 6/1997 | ..... | H01Q/9/04 |
| EP | 0871238 | 10/1998 | ..... | H01Q/9/04 |
| FI | 971235 | 9/1998 | ..... | H01Q/9/04 |
| JP | 61-41205 | * 2/1986 | ..... | H01Q/13/08 |

* cited by examiner

*Primary Examiner*—Hoanganh Le
(74) *Attorney, Agent, or Firm*—Darby & Darby

(57) ABSTRACT

The invention relates to an antenna structure to be installed inside small-sized radio apparatus. A conventional PIFA-type structure is extended such that on top of the ground plane (210) there will be instead of one at least two radiating planes (220, 230) on top of each other. There is between them dielectric material (240) to reduce the size of the lower radiator and to improve the band characteristics. Likewise, there is dielectric material (250) on top of the uppermost radiating plane so as to bring one resonance frequency of the antenna relatively close to another resonance frequency in order to widen the band. Advantageously the radiating planes are in galvanic contact (203) with each other. The invention accomplishes a greater increase in the antenna bandwidth as compared to that achieved by placing the only radiating plane at a distance from the ground plane equal to that of the upper radiating plane according to the invention.

6 Claims, 3 Drawing Sheets

INTERNAL ANTENNA FOR AN APPARATUS

CROSS-REFERENCE TO RELATED APPLICATION

This application claims priority from Finnish Patent Application No. 19992268, entitled "Internal Antenna for an Apparatus," filed on Oct. 20, 1999, the disclosure of which is hereby incorporated by reference in its entirety.

BACKGROUND OF THE INVENTION

1. Field of the Invention

The invention relates to an antenna structure to be installed inside sm radio apparatus.

2. Description of Related Art

In portable radio apparatus it is very desirable that the antenna be located inside the covers of the apparatus, for a protruding antenna is impractical. In modem mobile stations, for example, the internal antenna naturally has to be small in size. This requirement is further emphasized as mobile stations become smaller and smaller. Furthermore, in dual-band antennas the upper operating band at least should be relatively wide, especially if the apparatus in question is meant to function in more than one system utilizing the 1.7–2 GHz band.

When aiming at a small-sized antenna the most common solution is to use a PIFA (planar inverted F antenna). The performance, such as bandwidth and efficiency, of such an antenna functioning in a given frequency band or bands depends on its size: The bigger the size, the better the characteristics, and vice versa. For example, decreasing the height of a PIFA, i.e. bringing the radiating plane and ground plane closer to each other, markedly decreases the bandwidth. Likewise, reducing the antenna in the directions of breadth and length by making the physical lengths of the elements smaller than their electrical lengths especially degrades the efficiency.

Figure 1:
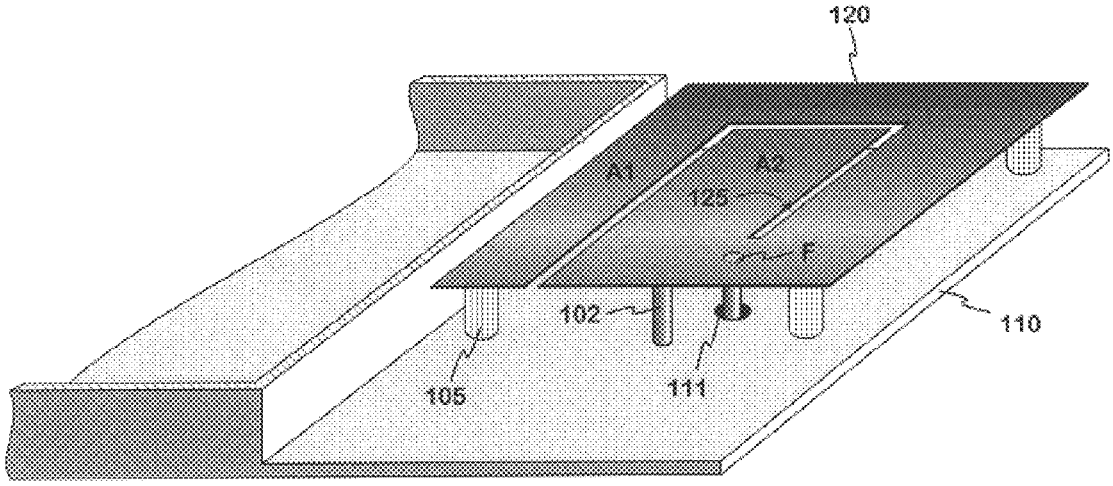
Fig. 1 PRIOR ART

FIG. 1 shows an example of a prior-art dual-band PIFA. Depicted in the figure is the frame 110 of the apparatus in question which is drawn horizontal and which functions as the ground plane of the antenna. Above the ground plane there is a planar radiating element 120 supported by insulating pieces, such as 105. Between the radiating element and ground plane there is a short-circuit piece 102. The radiating element 120 is fed at a point F through a hole 103 in the ground plane. In the radiating element there is a slot 125 which starts from the edge of the element and extends to near the feed point F after having made two rectangular turns. The slot divides the radiating element, viewed from the feed point F, into two branches A1 and A2 which have different lengths. The longer branch A1 comprises in this example the main part of the edge regions of the radiating element, and its resonance frequency falls on the lower operating band of the antenna. The shorter branch A2 comprises the middle region of the radiating element, and its resonance frequency falls on the upper operating band of the antenna. The disadvantage of structures like the one described in FIG. 1 is that the tendency towards smaller antennas for compact mobile stations will in accordance with the foregoing degrade the electrical characteristics of an antenna too much.

SUMMARY OF THE INVENTION

The object of the invention is to reduce the aforementioned disadvantages associated with the prior art. The structure according to the invention is characterized by what is expressed in the independent claim 1. Preferred embodiments of the invention are presented in the other claims.

The basic idea of the invention is as follows: A conventional PIFA type structure is extended is such a manner that instead of one there will be at least two radiating planes on top of each other above the ground plane. Between them there is dielectric material in order to reduce the size of the lower radiator and to improve band characteristics. Likewise, there is dielectric material on top of the uppermost radiating plane. This top layer is used to bring one resonance frequency of the antenna relatively close to another resonance frequency in order to widen the band. The upper radiating plane is advantageously galvanically connected to the lower radiating plane.

An advantage of the invention is that it achieves a greater increase in the antenna bandwidth than what would be achieved by placing the only radiating plane at a distance from the ground plane equal to that of the upper radiating plane according to the invention. This is due to the use of multiple resonance frequencies close to each other. Other advantages of the invention include relatively good manufacturability and low manufacturing costs.

The invention will now be described in detail. Reference will be made to the accompanying drawings in which

BRIEF DESCRIPTION OF THE ILLUSTRATIVE EMBODIMENTS

Figure 2:
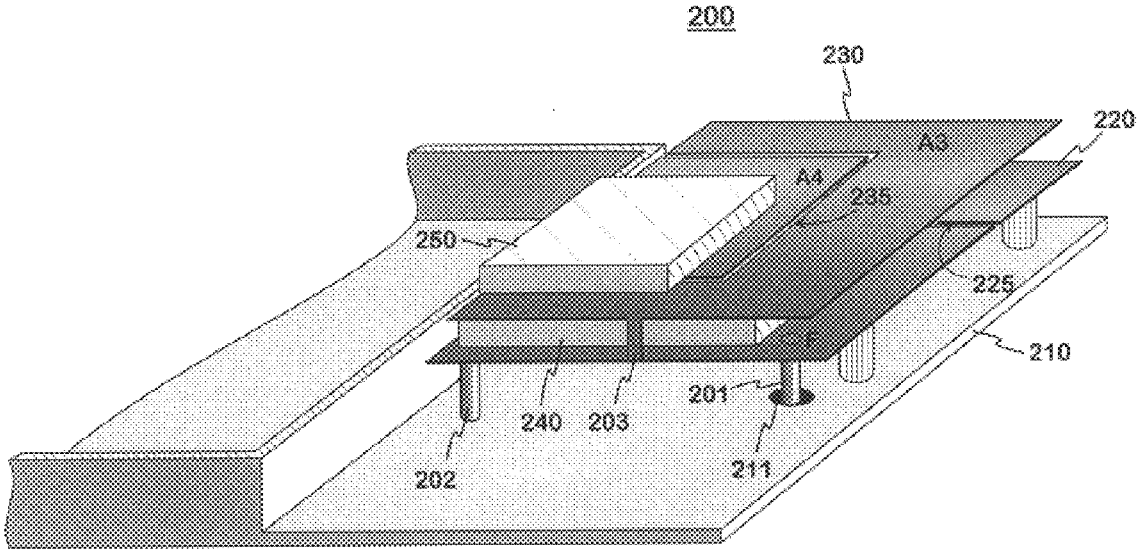
Figure 3:
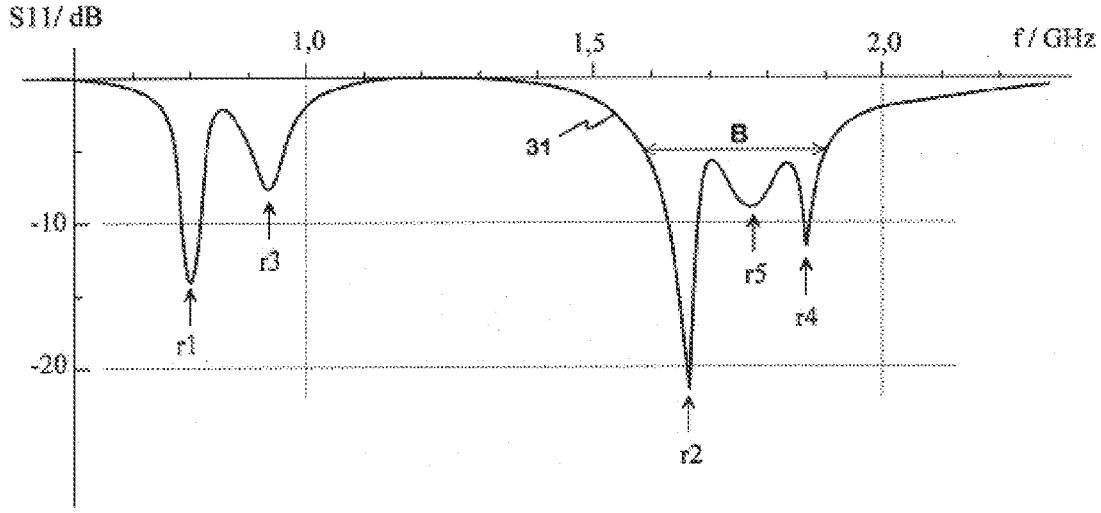
Figure 7:
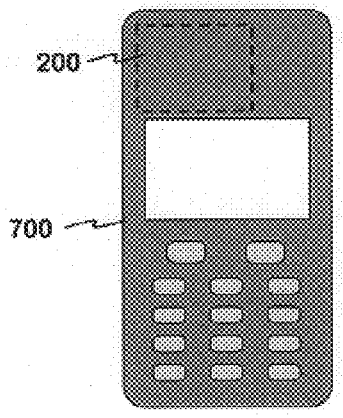
Figure 4A:
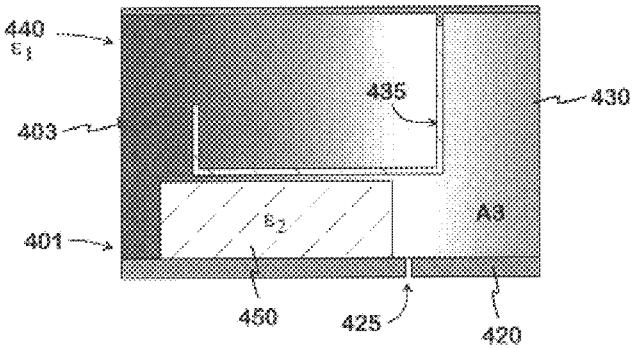
Figure 4B:
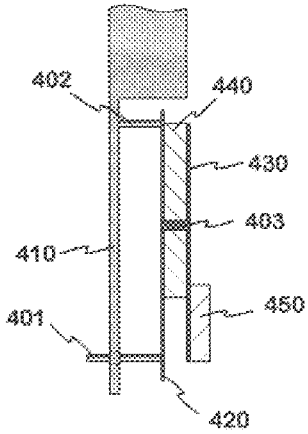
Figure 5A:
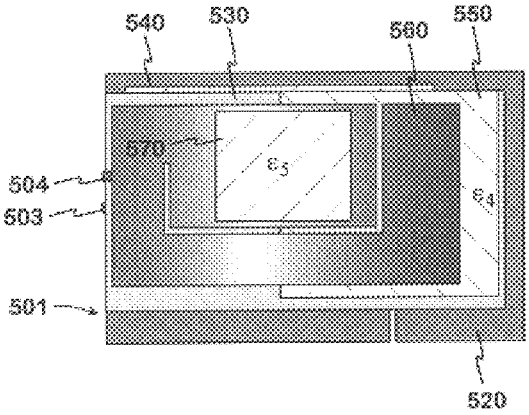
Figure 5B:
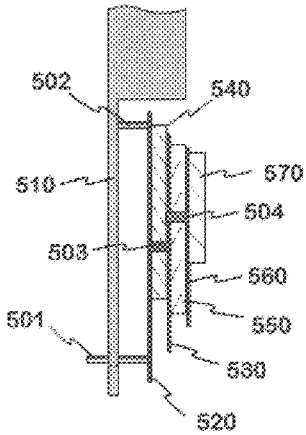
Figure 6A:
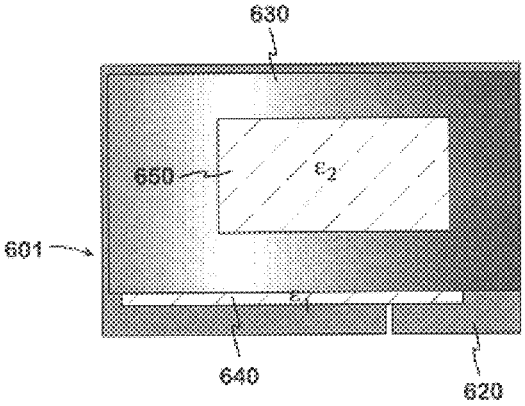
Figure 6B:
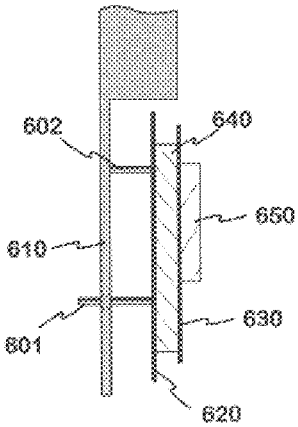

FIG. 1 shows an example of a prior-art PIFA,

FIG. 2 shows an example of the antenna structure according to the invention, FIG. 3 shows an example of the characteristics of the antenna according to the invention, FIG. 4*a* and 4*b* show a second embodiment of the invention, FIG. 5*a* and 5*b* show a third embodiment of the invention, FIG. 6*a* and 6*b* show a fourth embodiment of the invention, and FIG. 7 shows an example of a mobile station equipped with an antenna according to the invention.

DETAILED DESCRIPTION OF THE ILLUSTRATIVE EMBODIMENTS

FIG. 1 was already discussed in connection with the description of the prior art.

FIG. 2 shows an example of the antenna structure according to the invention. An antenna 200 comprises a ground plane 210, on top of that a first radiating element 220 and further on top of that a second radiating element 230. The words "on top" and "uppermost" refer in this description and in the claims to the relative positions of the component parts of the antenna when they are horizontal and the ground plane is the lowest. Between the ground plane and the first radiating element there is mainly air and a little supporting material having a low dielectric constant. Between the first and second radiating element there is a dielectric board 240 having a relatively high dielectric constant. The dielectric constant has a value of at least ten. On top of the second radiating element there is a second dielectric board 250. The inner conductor 201 of the antenna feed is connected at a point F to the first radiating plane 220 through a hole 211 in the ground plane. In accordance with the PIFA structure, the first radiating plane is connected to ground by means of a first short-circuit conductor 202. Furthermore, the first and second radiating planes are galvanically connected. In the example of FIG. 2, this connection is realized by means of a second short-circuit conductor 203 in the area between the feed point F and the short-circuit conductor 202. The second radiating plane 230 is fed partly galvanically through short-circuit conductor 203 and partly electromagnetically from the first plane 220.

In the exemplary structure depicted in FIG. 2 the both radiating planes comprise two branches: The first radiating plane 220 has a slot 225 which divides it into two branches having different resonance frequencies. Let these resonance frequencies be $f_1$ and $f_2$, of which $f_2$ is higher. The second radiating plane 230 has a slot 235 which divides it into two branches A3 and A4 having different resonance frequencies. Let these resonance frequencies of the upper radiating plane be $f_3$ and $f_4$, of which $f_4$ is higher. The dielectric board 250 is located on top of branch A4. That and the size of branch A4 are utilized to bring resonance frequency $f_4$ to so near resonance frequency $f_2$ that the operating bands corresponding to the frequencies $f_2$ and $f_4$ form a continuous, wider operating band. Moreover, the dielectric board 250 improves the reliability of oscillation of branch A4.

FIG. 3 shows a curve 31 depicting a reflection coefficient S11 as a function of frequency f for an antenna built according to the invention. The exemplary antenna is adapted so as to have four resonance frequencies as above in the structure of FIG. 2. The first resonance $r_1$ appears at $f_1$=0.8 GHz, the second resonance $r_2$ at $f_2$=1.66 GHz, the third resonance $r_3$ at $f_3$=0.94 GHz, and the fourth resonance $r_4$ appears at $f_4$=1.87 GHz. The reflection coefficient peaks are, respectively, 14 dB, 21 dB, 7½ dB and 12 dB. The operating frequency bands corresponding to resonances $r_1$ and $r_3$ are separate. The coupling between antenna elements corresponding to resonances $r_2$ and $r_4$ results in a fifth resonance $r_5$ the frequency of which falls between $f_2$ and $f_4$. Together the frequency bands corresponding to resonances $r_2$, $r_4$ and $r_5$ constitute a wide operating frequency band. This frequency band will be about 1.6 to 1.9 GHz if a reflection coefficient of 5 dB is used as the band limit criterion. The bandwidth B is thus about 300 MHz, which is 17% in relation to the center frequency of the band. This is clearly more than the bandwidth achieved by a prior-art antenna of the same size.

FIG. 4*a* is an overhead view of an embodiment of the invention nearly similar to that of FIG. 2. There is shown a first radiating element 420, second radiating element 430, first dielectric board 440 and a second dielectric board 450. A slot 425 divides the first and slot 435 the second radiating element into two branches. The second radiating element is in this example nearly as large as the first. They are connected at the edge of the structure by a second short-circuit conductor 403. The first dielectric board has a dielectric constant $\epsilon_1$ and the second dielectric board has a dielectric constant $\epsilon_2$. The difference from FIG. 2 is that the second dielectric board is now located on top of the longer branch A3 of the second radiating element. FIG. 4*b* shows the structure of FIG. 4*a* viewed from its left side. There is shown in addition to the aforementioned parts a ground plane 410, inner conductor 401 of the antenna feed line, and a first short-circuit conductor 402 between the ground plane and first radiating element. A short-circuit conductor 403 between the first and second radiating element advantageously starts from the area between the inner conductor 401 and first short-circuit conductor. Additionally, FIG. 4*b* shows that the insulator between the ground plane and first radiating element is air.

FIG. 5*a* is an overhead view of an embodiment of the invention with three radiating elements on top of each other. At the bottom there is a first radiating element 520 which has two branches. In the middle there is a second radiating element 530 which is continuous and smaller than the first radiating element. At the top there is a third radiating element 560 which has two branches and is even smaller than the second radiating element. Between the first and second radiating element there is a first dielectric board 540, and between the second and third radiating element there is a second dielectric board 550. On top of the shorter branch of the third radiating element there is a third dielectric board 570. At the edge of the structure there is a second short-circuit conductor 503 between the first and second radiating element, and a third short-circuit conductor 504 between the second and third radiating element.

FIG. 5*b* shows the structure of FIG. 5*a* viewed from its left side. There is shown in addition to the aforementioned parts a ground plane 510, inner conductor 501 of the antenna feed line, and a first short-circuit conductor 502 between the ground plane and first radiating element. The structure according to FIGS. 5*a*, 5*b* can be used to realize e.g. a three-band antenna, in which one of the bands is especially widened, or a dual-band antenna, in which one or both of the bands are especially widened.

FIG. 6*a* is an overhead view of an embodiment of the invention with two radiating elements on top of each other. It differs from the structure of FIG. 4 in that the second radiating element 630 is continuous and is not in galvanic contact with the first radiating element 620. So, in this example the second radiating element is parasitic. FIG. 6*b* shows the structure of FIG. 6*a* viewed from its left side. There is shown in addition to the aforementioned parts a ground plane 610, inner conductor 601 of the antenna feed line, and a first short-circuit conductor 602 between the ground plane and first radiating element.

FIG. 7 shows a mobile station 700. It includes an antenna 200 according to the invention, located in this example entirely within the covers of the mobile station.

Above it was described an antenna structure according to the invention and some of its variations. The invention is not limited to them as regards the design and number of radiating elements and the placement of dielectric material. Furthermore, the invention does not limit other structural solutions of the planar antenna nor its manufacturing method. The inventional idea may be applied in various ways within the scope defined by the independent claim 1.

What is claimed is:

1. An antenna structure comprising a ground plane, a first planar radiating element and on top of the first radiating element at least a second radiating element, whereby the space between the first radiating element and said ground plane comprises substantially air, between the second radiating element and first radiating element there is material the dielectric constant of which is at least ten, and on top of the second radiating element there is a layer of dielectric material, wherein the dielectric material layer widens an operating band and improves an oscillation of the antenna structure.

2. The structure of claim 1, wherein between said first and second radiating elements there is a second short-circuit conductor to provide galvanic coupling.

3. The structure of claim 2, wherein a feed conductor of said antenna structure is in galvanic contact with the first radiating element and there is between the first radiating element and said ground plane a first short-circuit conductor, wherein in the first radiating element the connection point of said second short-circuit conductor is located in the area between the connection point of said feed conductor and the connection point of said first short-circuit conductor.

4. The structure of claim 1, characterized in that at least one of said radiating elements comprises two branches (A3, A4) which have substantially different resonance frequencies.

5. The structure of claim 1, characterized in that at least one (630) of said radiating elements is parasitic.

6. A radio apparatus comprising an antenna having a ground plane, a first radiating element and on top of the first radiating element there is at least a second radiating element, whereby the space between the first radiating element and said ground plane comprises substantially air, and there is between the second radiating element and first radiating element the dielectric constant of which is at least ten, and there is on top of the second radiating element a layer of dielectric material, wherein the dielectric material layer widens an operating band and improves an oscillation of the antenna.

* * * * *